US007445463B2

(12) United States Patent
Tang et al.

(10) Patent No.: US 7,445,463 B2
(45) Date of Patent: Nov. 4, 2008

(54) LAND GRID ARRAY ELECTRICAL CONNECTOR

(75) Inventors: Qing-Yi Tang, Shenzhen (CN); Fu-Jing Peng, Shenzhen (CN); Yao-Chi Huang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/515,579

(22) Filed: Sep. 5, 2006

(65) Prior Publication Data

US 2007/0054531 A1 Mar. 8, 2007

(30) Foreign Application Priority Data

Sep. 5, 2005 (TW) ..... 94215181 U

(51) Int. Cl.
*H01R 12/00* (2006.01)

(52) U.S. Cl. ..... 439/71

(58) Field of Classification Search ..... 439/71, 439/525, 526

See application file for complete search history.

(56) References Cited

U.S. PATENT DOCUMENTS

| | | | | |
|---|---|---|---|---|
| 6,746,253 | B1 * | 6/2004 | Ma | 439/71 |
| 6,821,163 | B2 * | 11/2004 | McHugh et al. | 439/733.1 |
| 7,128,580 | B2 * | 10/2006 | Liao et al. | 439/71 |
| 2005/0014398 | A1 * | 1/2005 | Liao et al. | 439/71 |
| 2005/0245108 | A1 * | 11/2005 | Liao et al. | 439/71 |

* cited by examiner

*Primary Examiner*—Gary F. Paumen
(74) *Attorney, Agent, or Firm*—Wei Te Chung

(57) ABSTRACT

In a land grid array connector for electrically connecting a chip module to a printed circuit board, comprising: an insulative housing and a plurality of contacts, the housing including side walls and a central portion surrounded by the side walls, the central portion having a first mounting face toward the chip module, a second mounting face toward the printed circuit board, and a plurality of grooves receiving the contacts, at least two of the side walls each including a spring arm extending into the central portion, the improvement wherein a protrusion is disposed on at least one of the spring arm and the associated side wall.

10 Claims, 3 Drawing Sheets

LAND GRID ARRAY ELECTRICAL CONNECTOR

BACKGROUND OF THE INVENTION

1. Field of the Invention

The present invention relates to a land grid array (LGA) electrical connector, and more particularly to a LGA connector that is interconnected between a chip module and a printed circuit board.

2. Description of Related Art

LGA electrical connectors are widely used in electronic industry for interconnecting high speed, high density signals between two electronic elements.

Referring to FIG. 5, a LGA connector is shown connecting a chip module 7 to a printed circuit board (PCB) 9. The connector has an insulative housing 6 and a plurality of contacts 5. The housing 6 includes a central portion 65 and four side walls 61, together defining a receiving space 63 for the chip module 7. The central portion 65 has a plurality of arrayed grooves 60. The contact 5 is substantially C-shaped and has a first contacting leg 51 and an opposite second contacting leg (not visible) extending beyond a first mounting face and a second mounting face of the central portion 65, respectively. In assembly, the contact 5 is compressed between the chip module 7 and the PCB 9, thereby electrically connecting the same.

Since a pressing contact is required between the chip module 7 and the connector, the side wall 61 is disposed a spring arm 66 extending into the receiving space 63 in order to ensure a proper relative position therebetween. When the chip module 7 is mounted to the connector, the spring arm 66 elastically abuts against, and thus securely positions or clamps, the chip module 7.

However, to ensure that the spring arm 66 undergoes elastic deformation, it is customary to design a longer arm. After repeated use, the junction portion of the arm 66 to the wall 61 is apt to break, resulting in difficulty in mounting of the chip module 7.

In view of the above, there is a need to design a connector that may solve the above problem.

SUMMARY OF THE INVENTION

An object of the present invention is to provide an electrical connector that prevents breakage or damage of a spring arm.

To achieve the above object, a land grid array connector for electrically connecting a chip module to a printed circuit board comprises: an insulative housing and a plurality of contacts, the housing including side walls and a central portion surrounded by the side walls, the central portion having a first mounting face toward the chip module, a second mounting face toward the printed circuit board, and a plurality of grooves receiving the contacts, at least two of the side walls each including a spring arm extending into the central portion, wherein a protrusion is disposed on at least one of the spring arm and the associated side wall.

Other objects, advantages and novel features of the invention will become more apparent from the following detailed description when taken in conjunction with the accompanying drawings.

DETAILED DESCRIPTION OF THE PREFERRED EMBODIMENT

Figure 1:
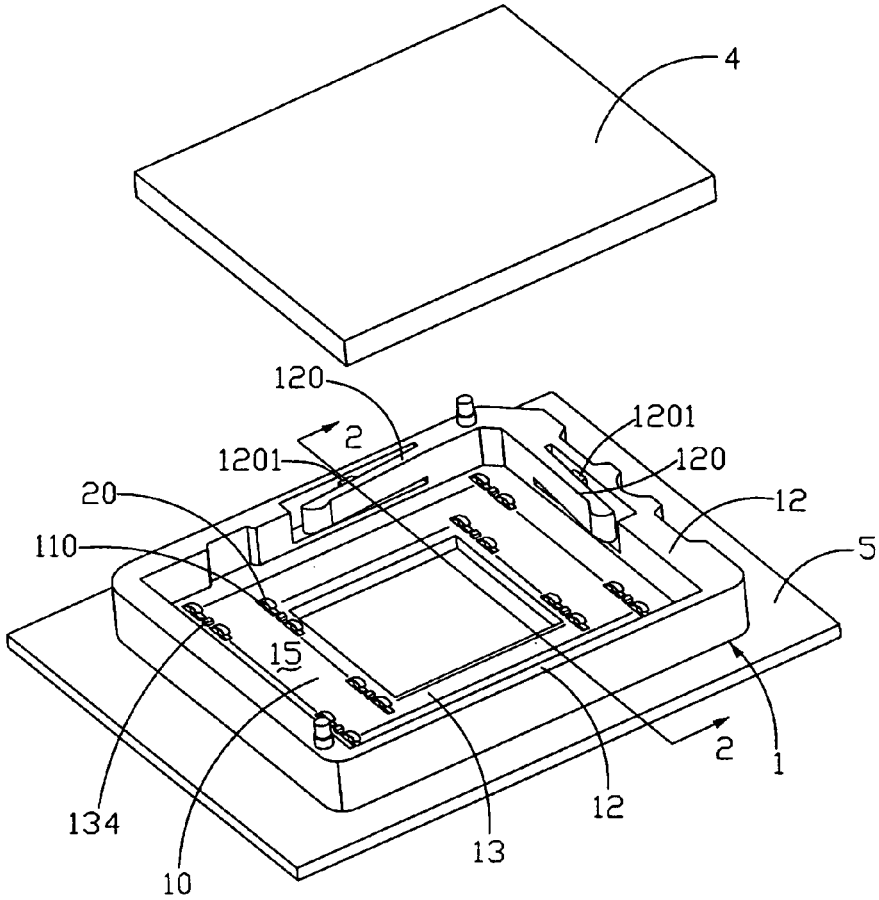
FIG. 1 is a perspective view of a land grid array connector, together with a chip module and a PCB, in accordance with the present invention.
Figure 2:
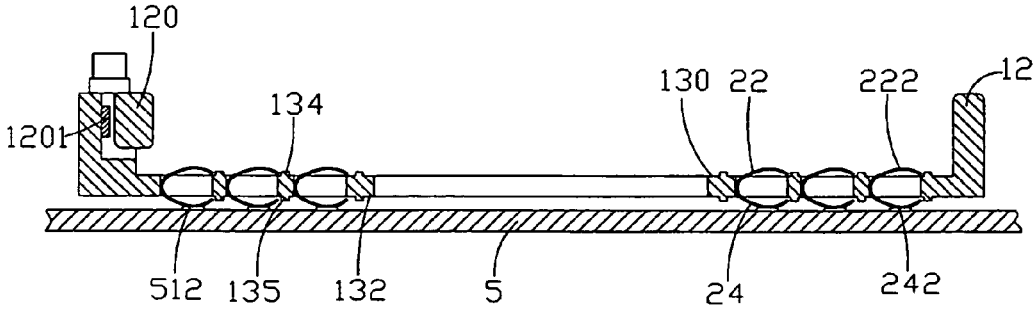
FIG. 2 is a cross-sectional view taken along line 2-2 in FIG. 1.
Figure 3:
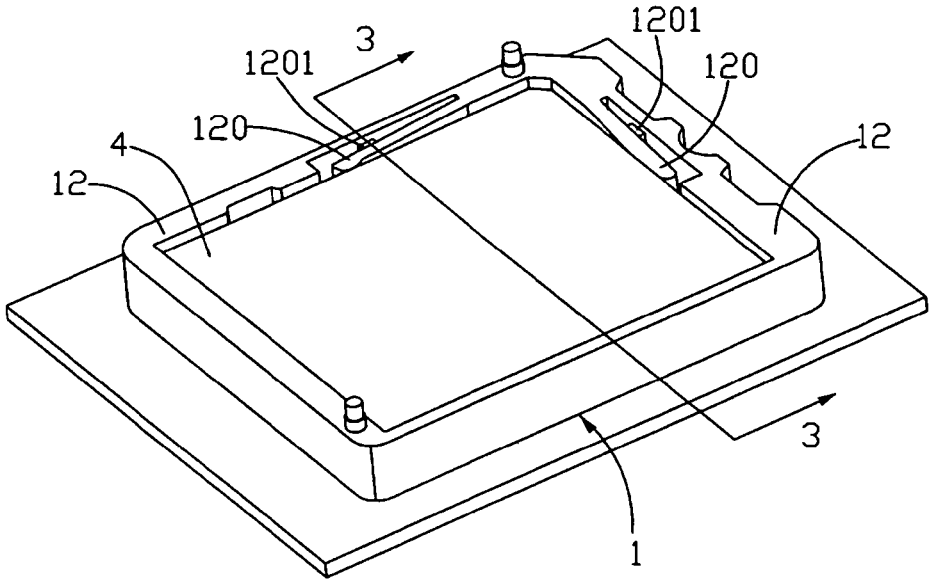
FIG. 3 is a view similar to FIG. 1 but with the chip module mounted in place.
Figure 4:
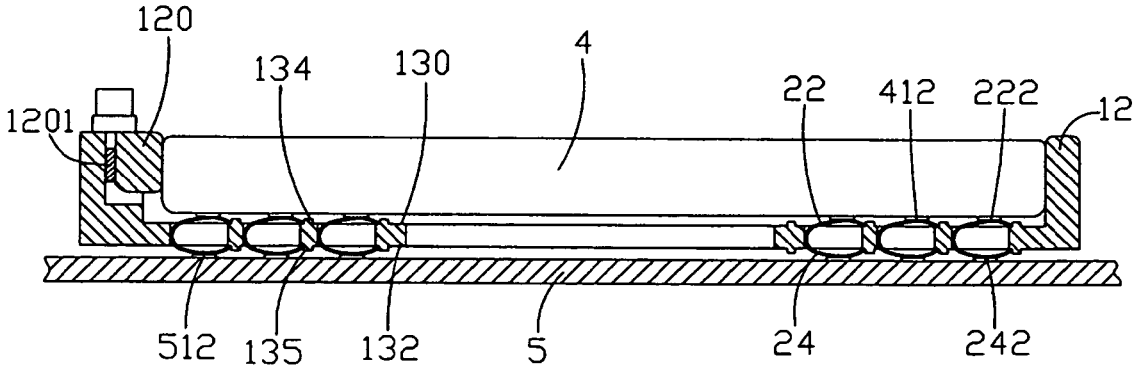
FIG. 4 is a cross-sectional view taken along line 4-4 in FIG. 3.
Figure 5:
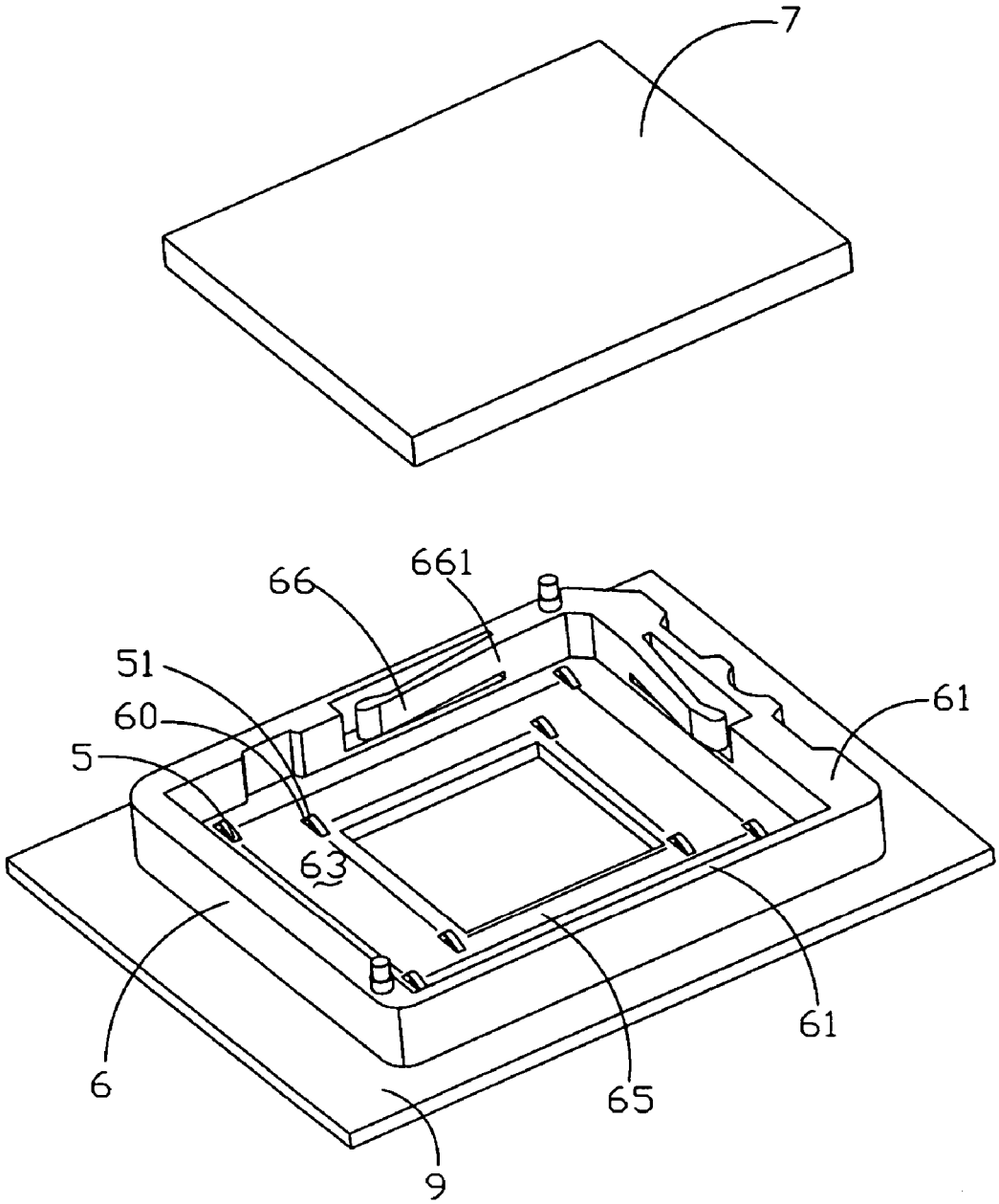
FIG. 5 shows a conventional land grid array connector, together with a chip module and a PCB.

Referring to FIGS. 1 through 4, the present invention relates to a land grid array connector 1 for electrically connecting a chip module 4 to a printed circuit board (PCB) 5 and comprises an insulative housing 10 and a plurality of contacts 20 received in the housing 10.

The housing 10 is generally rectangular and comprises a central base portion 13 and four side walls 12 surrounding the central portion. The central portion 13 has an upper mounting face 130, a lower mounting face 132, and a plurality of grooves 110 receiving the contacts 20. Between two adjacent grooves 110 there is provided an upper raised block 134 and a lower raised block 135 in either a row direction or a column direction. In the embodiment shown the blocks are arranged in such a direction along which the contacts 20 are designed to deform. The four side walls 12 and the central portion 13 together define a receiving space 15 for the chip module 4. Two adjacent ones of the four side walls 12 each have a spring arm 120 for bearing against the chip module 4. A gap exists between the spring arm 120 and associated side wall 12 so as to permit a resilient movement of the former. Specifically, a protrusion 1201 is shown disposed on the side wall 12 and, again, a gap exists therebetween for permitting a resilient movement of the spring arm 120.

The contact 20 is substantially C-shaped and all contacts are open to the same direction. The contact 20 has an upper contacting leg 22 and a lower contacting leg 24 each having a respective contact portion 222 and 242. The upper contact portion 222 extends away from the central portion 13 beyond the upper raised block 134 for connecting with contact pad 412 on the chip module 4; the lower contact portion 242 extends away from the central portion 13 below the lower raised block 134 for connecting with conductive pad or trace 512 on the PCB 5.

In mounting the chip module 4 to the connector 1, the sides of the chip module 4 will move the two spring arms 120 and therefore force the latter to elastically deform and be displaced toward the side walls 12, thereby reliably positioning the module 4 in the receiving space 15 with the contact portions 222 pressing against the contact pads 412 on the chip module 4 and the contact portions 242 pressing against the conductive pads 512 on the PCB 5 and establishing an electrical connection between the chip module 4 and the PCB 5. After mounting the chip module 4 to the connector 1, the protrusion 1201 will bear against the spring arm 120, preventing the spring arm 120 from over-stressing or even plastically deformed or breakage.

Also, in mounting the chip module 4 to the connector 1, the contacting legs 22 and 24 of the contact 20 each undergo a horizontal movement toward corresponding adjacent raised blocks 134 and 135, respectively. The raised blocks 134 and 135 act to prevent the contacting legs 22 and 24 from permanently deformed due to over-stressing. The raised blocks 134 and 135 further serve to separate adjacent contacting legs 22 or 24 from touching each other and therefore resulting in short circuiting.

While, in the above embodiment, the protrusion 1201 is disposed on the side wall 12 for contacting the spring arm 120, it is understood that the protrusion 1201 may be disposed on the spring arm 120 for contacting the side wall 12.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a land grid array connector for electrically connecting a chip module to a printed circuit board, comprising: an insulative housing and a plurality of contacts, the housing including side walls and a central portion surrounded by the side walls, the central portion having a first mounting face toward the chip module, a second mounting face toward the printed circuit board, and a plurality of grooves receiving the contacts, at least two of the side walls each including a spring arm extending into the central portion, the improvement wherein a protrusion is disposed on the associated side wall of the housing to abut against the spring arm when the spring arm rotates toward the side wall.

2. The land grid array connector as claimed in claim 1, wherein the central portion of the housing comprises a plurality of first raised blocks on the first mounting face and a plurality of second raised blocks on the second mounting face.

3. The land grid array connector as claimed in claim 2, wherein the contacts are arrayed in rows and columns and are each substantially C-shaped in cross-section along the row direction, and wherein the first and second raised blocks each are disposed between two adjacent grooves along the row direction.

4. The land grid array connector as claimed in claim 3, wherein the contact has a first contacting leg extending away from the central portion beyond the first raised block and a second contacting leg opposite to the first contacting leg extending away from the central portion beyond the second raised block, and wherein each of the first and second contacting legs has a free end situated proximal to the associated raised block.

5. In a land grid array connector assembly comprising:

an insulative housing and a plurality of contacts, the housing including side walls and a central portion surrounded by the side walls, the central portion having a first mounting face toward the chip module, a second mounting face toward the printed circuit board, and a plurality of grooves receiving the contacts, at least one of the side walls including a cantilever spring arm extending into the central portion, a chip module received seated upon the central portion and outwardly deflecting the spring arm under a condition that the spring arm experiences a long-force-arm deflection during an initial deflection stage and a short-force-arm deflection during a final deflection stage.

6. In a land grid array connector for electrically connecting a chip module to a printed circuit board, comprising:

an insulative housing; and a plurality of contacts;

the housing including side walls and a central portion surrounded by the side walls, the central portion having a first mounting face toward the chip module, a second mounting face toward the printed circuit board, and a plurality of grooves receiving the contacts, at least two of the side walls each including a spring arm extending into the central portion, the improvement wherein a protrusion is disposed on at least one of the spring arm and the associated side wall and the central portion of the housing comprises a plurality of first raised blocks on the first mounting face and a plurality of second raised blocks on the second mounting face.

7. The land grid array connector as claimed in claim 6, wherein the protrusion is formed on the sidewall.

8. The land grid array connector as claimed in claim 6, wherein the protrusion is formed on the spring arm.

9. The land grid array connector as claimed in claim 6, wherein the contacts are arrayed in rows and columns and are each substantially C-shaped in cross-section along the row direction, and wherein the first and second raised blocks each are disposed between two adjacent grooves along the row direction.

10. The land grid array connector as claimed in claim 9, wherein the contact has a first contacting leg extending away from the central portion beyond the first raised block and a second contacting leg opposite to the first contacting leg extending away from the central portion beyond the second raised block, and wherein each of the first and second contacting legs has a free end situated proximal to the associated raised block.

* * * * *